US006004634A

United States Patent [19]

Aiken

[11] Patent Number: 6,004,634

[45] Date of Patent: Dec. 21, 1999

[54] NOVELTY DEVICE FOR ATTACHMENT TO AN ARTICLE

[75] Inventor: Mary Aiken, Dublin, Ireland

[73] Assignee: Megaprint Group Limited, Hampton Hill, United Kingdom

[21] Appl. No.: 08/905,826

[22] Filed: Aug. 4, 1997

[30] Foreign Application Priority Data

Aug. 7, 1996 [GB] United Kingdom ..... 9616564

[51] Int. Cl.[6] ..... A63H 3/00

[52] U.S. Cl. ..... 428/16; 428/136; 428/542.2

[58] Field of Search ..... 428/7, 16, 542.2, 428/136

[56] References Cited

U.S. PATENT DOCUMENTS

| | | | |
|---|---|---|---|
| 1,349,374 | 8/1920 | Gruenfeld, Jr. | 428/16 X |
| 2,603,810 | 7/1952 | Duhme | 428/16 X |
| 3,299,891 | 1/1967 | Smeton | 428/16 X |
| 3,488,769 | 1/1970 | Falkenberg | 428/16 X |
| 4,806,425 | 2/1989 | Chu-Ba | 428/372 X |

*Primary Examiner*—Henry F. Epstein
*Attorney, Agent, or Firm*—Welsh & Katz, Ltd.

[57] ABSTRACT

A novelty device (1) is provided for attachment to an article such as an eating utensil. The novelty device (1) has a device body (2) formed of a soft plastics material. The device body (2) has a slot (4) extending within the device body (2). The slot (4) tapers within the device body (2) in order to accommodate different shapes and sizes of article. The device body (2) can be molded as a character.

5 Claims, 2 Drawing Sheets

NOVELTY DEVICE FOR ATTACHMENT TO AN ARTICLE

This invention relates to a novelty device for attachment to an article, in particular for attachment to an eating utensil such as a spoon.

Novelty devices for attachment to articles such as spoons or pencils are known. Known articles include erasers for attachment to the top of pencils which contain a cylindrical hole which fits snugly over the top of a pencil. Articles for attachment to the top of eating utensils such as spoons are generally machined pieces in which the handle of the eating utensil is made to be glued into the article.

Novelty devices add interest to the top of eating utensils which are used by small children. Unfortunately, the ends of eating utensils come in a range of different shapes and sizes and therefore articles are not supplied for general attachment to the ends of eating utensils as they would need to be supplied in a range of different shapes and sizes.

SUMMARY OF THE INVENTION

According to the present invention there is provided a novelty device for attachment to an article comprising a device body formed of a soft plastics material, the device body having a slot therein, wherein the slot tappers within the device body.

Preferably, the soft plastics material is sufficiently flexible to allow the slot to expand to accommodate an article.

An air hole may be provided in the device body to allow the egress of air. This has the advantage of allowing air to escape from the device body when an article is inserted into the slot. The air hole is also a safety feature to provide an air passage through the device if swallowed by a child.

Preferably, the device body is moulded as a character. The article may be an eating utensil such as a spoon.

Preferably, the soft plastics material comprises resin, plasticizer, stabilizers, epoxidized plasticizer and lubricant.

BRIEF DESCRIPTION OF THE DRAWINGS

An embodiment of a novelty device for attachment to an article in accordance with the present invention is now described with reference to the accompanying drawings in which.

DETAILED DESCRIPTION OF THE INVENTION

Figure 1:
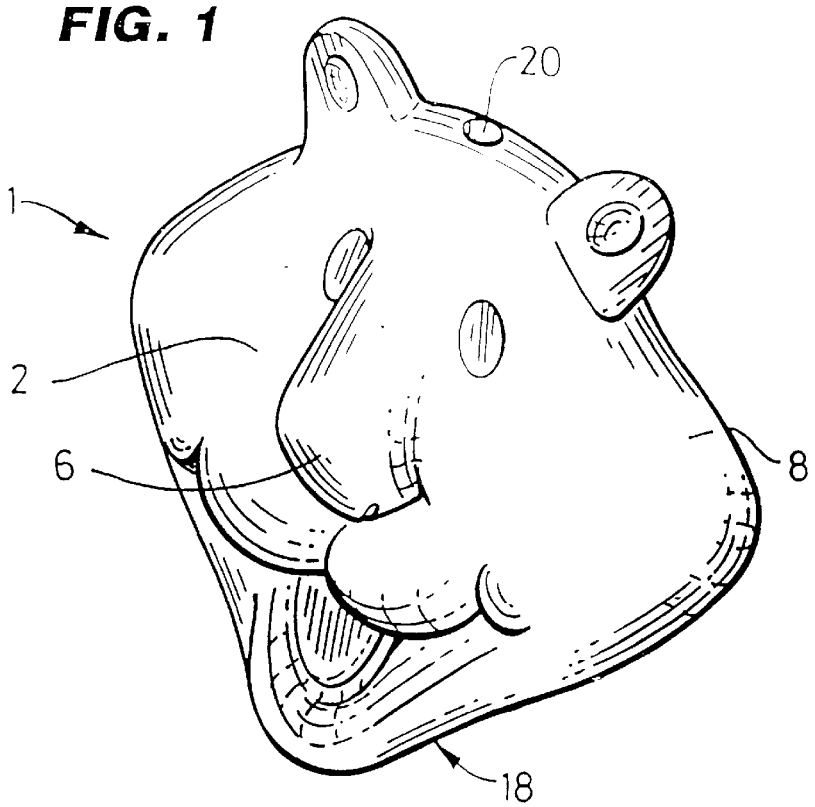
FIG. 1 is a front perspective view of the novelty device.
Figure 2:
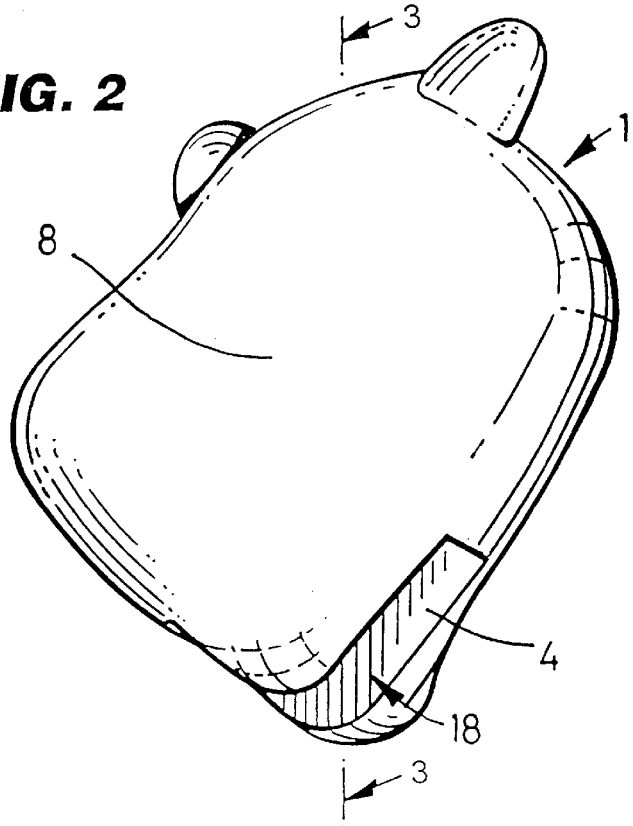
FIG. 2 is a back perspective view of the novelty device of FIG. 1.
Figure 3:
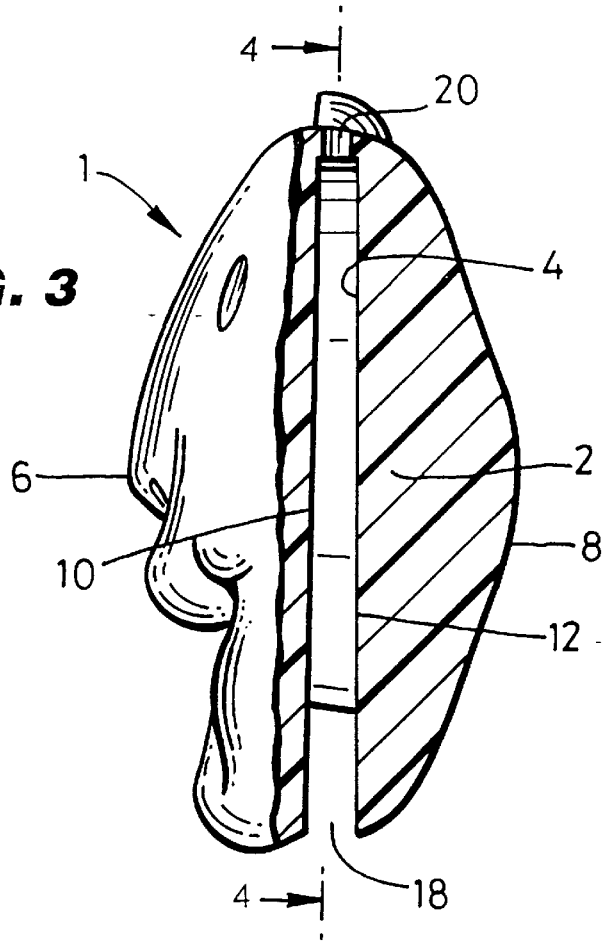
FIG. 3 is a cross-section through line 3—3 of FIG. 2.
Figure 4:
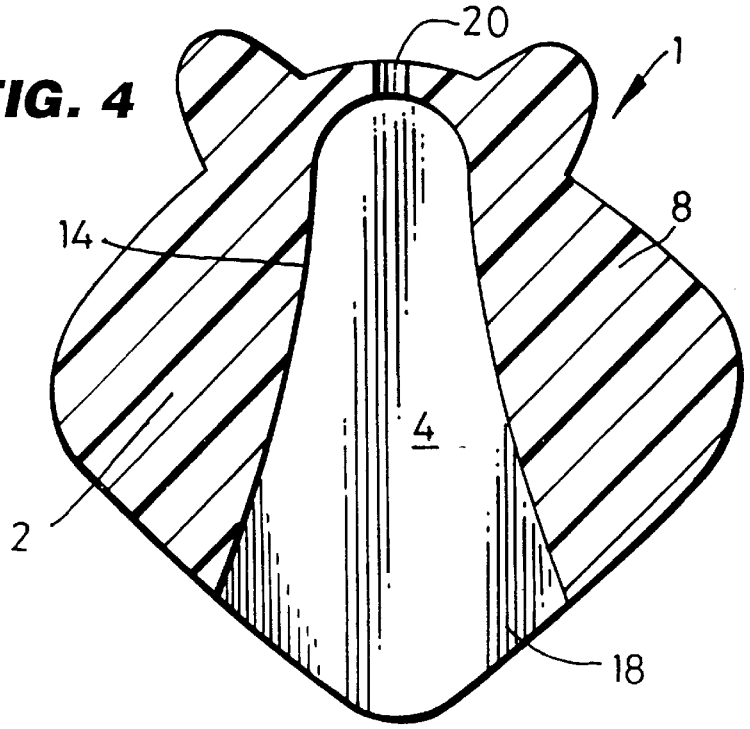
FIG. 4 is a cross-section through line 4—4 of FIG. 3.

Referring to the drawings, a novelty device 1 is provided for attachment to an article such as an eating utensil, specifically a spoon.

The device 1 has a device body 2 formed of a soft plastics material. The device body 2 has a slot 4 which extends from an opening 18 in the device body 2 into the interior of the device body 2. The slot 2 has a flat front surface 4 which is generally parallel to the front 6 of the device body 2 and a back surface 12 which is generally parallel to the back 8 of the device body 2. The slot 4 has two opposing sides 14 which join the front and back surfaces 10, 12 of the slot 4. The two opposing sides 14 are tapered such that they approach each other as the slot 4 extends within the interior of the device body 2.

The slot 4 is also tapered as the front and back surfaces 10, 12 of the slot 4 approach each other as the slot 4 extends within the interior of the device body 2.

An air hole 20 is provided in the top of the device body 2 opposite to the slot opening 18. The air hole 20 allows the egress of air from within the slot 4 when an article is inserted into the slot 4 blocking the opening 18. The air hole 20 also provides an air passage through the device body 2 which acts as a safety feature in the event that the device 1 is swallowed by a child.

A portion of the front 6 of the device body 2 can extend below the opening 18 of the slot 4.

The soft plastics material in which the device body 2 is formed is a composition of resin, plasticizer, stabilisers, epoxydized plasticiser and lubricant. The following ingredients form a suitable soft plastics material. The percentage breakdown of the ingredients is given in brackets:

Resin—PVC resin (61.44%);

Plasticizer—DINP (35.00%);

Stabilizers—Calcium/Zinc stabilizers (1.84%);

Epoxidized plasticizer—Epoxidized soya bean oil (1.54%);

Lubricant—Zinc stearate (0.18%).

The device 1 is formed as a character head such that the head sits on the top of an article such as an eating utensil. The slot 4 is tapered to allow the device body 2 to accommodate different shapes of ends of articles. The device body 2 is designed to taper in a proportionate manner corresponding to the taper of the slot 4 within the device body 2.

Smaller articles can be pushed up within the slot 4 and the soft plastics material will hug the contour of the article. In the case of eating utensils such as spoons, the end is often not straight but slightly curved in which case the soft plastics material will accommodate the shape of the eating utensil.

Modifications and improvements can be made to the forgoing without departing form the scope of the present invention.

I claim:

1. A novelty device molded of a soft plastic material for attachment to an end portion of an article, said novelty device comprising a body having a decorative feature on an exterior portion, an opening at one end thereof and a slot in an interior portion, said slot extending from said opening within said body for acceptance of the end portion of the article, an air hole in said body opposite said opening, said slot comprising at least four surfaces, each of said surfaces being contiguous to an adjacent surface, a first and second surface being opposite and substantially parallel to one another; a third and fourth surface opposing one another, said third and fourth surfaces tapering away from one another towards said opening to permit said slot to accept articles having end portions of different sizes and shapes.

2. A novelty device as claimed claim 1, wherein the soft plastics material is sufficiently flexible to allow the slot to expand to accommodate an article.

3. A novelty device as claimed in claim 1, wherein the device body is moulded as a character.

4. A novelty device as claimed in claim 1, wherein the article is an eating utensil.

5. A novelty device molded of a soft plastic material for attachment to an end portion of an article, said novelty device comprising a body having a decorative feature on an exterior portion, an opening at one end thereof and a slot in an interior portion, said slot extending from said opening within said body for acceptance of the end portion of the article, an air hole in said body opposite said opening, said slot comprising a tapered surface, said tapered surface having an interior end adjacent said air hole, said surfaces tapering outwardly to said opening thereby permitting said slot to accept articles having end portions of different sizes and shapes.

* * * * *